US011737488B2

(12) United States Patent
Farraj et al.

(10) Patent No.: US 11,737,488 B2
(45) Date of Patent: Aug. 29, 2023

(54) PRE-ROLL PACKING SYSTEM AND DEVICE

(71) Applicant: Sream, Inc., Riverside, CA (US)

(72) Inventors: Jarir Farraj, Corona, CA (US); Michael A. Burris, Riverside, CA (US)

(73) Assignee: Sream, Inc., Riverside, CA (US)

( * ) Notice: Subject to any disclaimer, the term of this patent is extended or adjusted under 35 U.S.C. 154(b) by 93 days.

(21) Appl. No.: 17/108,975

(22) Filed: Dec. 1, 2020

(65) Prior Publication Data

US 2022/0167660 A1 Jun. 2, 2022

(51) Int. Cl.
*A24C 5/02* (2006.01)
*A24C 5/39* (2006.01)

(52) U.S. Cl.
CPC ..... *A24C 5/02* (2013.01); *A24C 5/398* (2013.01); *A24C 5/399* (2013.01)

(58) Field of Classification Search
CPC ..... A24C 5/02; A24C 5/398
USPC ..... 131/280
See application file for complete search history.

(56) References Cited

U.S. PATENT DOCUMENTS 4,555,011 A * 11/1985 Brown ..... B65G 43/08 198/572
4,572,216 A 2/1986 Josuttis et al.
4,617,974 A 10/1986 Focke et al.
4,771,793 A 9/1988 Kastner
5,515,873 A 5/1996 Dawson et al.
5,666,975 A 9/1997 Lord
6,557,560 B2 5/2003 Kastner
8,171,939 B2 5/2012 Bao
8,453,686 B2 6/2013 Klaus et al.
8,522,791 B2 9/2013 Neumann
9,661,877 B2 5/2017 Bao
10,154,686 B2 12/2018 Heidtmann
10,231,479 B2 3/2019 Coltrane
2008/0257364 A1 10/2008 Neumann et al.
2011/0011411 A1 1/2011 Accordino et al.
2011/0239591 A1 10/2011 Gruss et al.
2011/0265805 A1 11/2011 Laplante
2018/0303152 A1* 10/2018 Douglas ..... A24C 1/02
(Continued)

OTHER PUBLICATIONS

Screen captures from YouTube video clip entitled "King Kone Overview," 4 pages, uploaded on Aug. 7, 2020 by user "Custom Cones USA". Retrieved from Internet: < https://www.youtube.com/watch?v=nQ-9Sc3chD4&t=124s>.*
(Continued)

*Primary Examiner* — Kelly M Gambetta
*Assistant Examiner* — Katherine A Will
(74) *Attorney, Agent, or Firm* — Olav M. Underdal; IDP Patent Services

(57) ABSTRACT

A pre-roll packing device includes a tube receiving structure with a plurality of receiving tubes and a removable lid, such that a plurality of pre-rolled tubes can be inserted into the tube receiving structure, such that the smoking material can be dispensed onto an upper surface of the tube receiving structure, such that a user can place the removable lid atop the tube receiving structure, such that the pre-roll packing device creates a vertical movement of parts of the pre-roll packing device, such that the plurality of pre-rolled tubes are uniformly filled and packed with the smoking material.

18 Claims, 12 Drawing Sheets

(56) References Cited

U.S. PATENT DOCUMENTS

2020/0268205 A1* 8/2020 Minard ..... A47J 37/045

OTHER PUBLICATIONS

Screen captures from YouTube video clip entitled "3D Dual Motor Vibration Plate Demo Video," 6 pages, uploaded on Jun. 5, 2018 by user "Bluefin Fitness". Retrieved from Internet: < https://www.youtube.com/watch?v=JgenpDHud_8&t=4s>.*

Kingkoneusa, KingKone Product 3.0, Dec. 10, 2019, Internet, https://www.instagram.com/p/B56zjnWF0Vo/, USA.

Kingkoneusa, KingKone Prototype 2.1, Nov. 26, 2019, Internet, https://www.instagram.eom/p/B5WX2MlljlJ/, USA.

Kingkoneusa, Product 2.0, Sep. 12, 2019, Internet, https://www.instagram.eom/p/B2U64KVIOrP/, USA.

Sream Inc., Corporation—Statement of Information, Feb. 10, 2022, https://bizfileonline.sos.ca.gov/search/business (C3353604), California Secretary of State, USA.

Jarir F. Farraj, Trademark Reg. No. 6,399,403, Jun. 29, 2021, https://tsdr.uspto.gov/#caseNumber-88676284&caseSearchType=US_APPLICATION&caseType=DEFAULT&searchType=documentSearch, USPTO, USA.

* cited by examiner

Pre-Roll Packing Device

Pre-Roll Packing Device

Pre-Roll Packing Device

Pre-Roll Packing Control System

Control Unit

PRE-ROLL PACKING SYSTEM AND DEVICE

CROSS-REFERENCE TO RELATED APPLICATIONS

N/A.

FIELD OF THE INVENTION

The present invention relates generally to the field of cannabis production, and more particularly to methods and systems for packing of a processed cannabis material into pre-rolled tubes.

BACKGROUND OF THE INVENTION

Consumers will frequently individually pack the processed cannabis powder by hand into the rolled tube for cannabis usage.

However, such systems often require a secondary pressure surface to pack the processed cannabis powder, resulting in the density and overall mass of the processed cannabis powder that is inputted into the rolled tube to be variable in amount, furthermore, such systems are often time consuming and leads to product wastage and large scale cleanup necessity and are impractical in the mass production of a filled tube for cannabis usage.

As such, considering the foregoing, it may be appreciated that there continues to be a need for novel and improved devices and methods for tube packing system and device for the efficient packing of the processed cannabis powder to a multitude of tubes for mass production of filled tubes for cannabis usage.

SUMMARY OF THE INVENTION

The foregoing needs are met, to a great extent, by the present invention, wherein in aspects of this invention, enhancements are provided to the existing model of packing of processed cannabis material into pre-rolled tubes.

In an aspect, a pre-roll packing device for packing a plurality of pre-rolled tubes with a smoking material, such that the pre-roll packing device can include:

a) a tube receiving structure; and b) a removable lid;

wherein the plurality of pre-rolled tubes can be inserted into the tube receiving structure, such that the smoking material can be dispensed onto an upper surface of the tube receiving structure;

such that a user can place the removable lid atop the tube receiving structure;

such that the pre-roll packing device can be configured to create a vertical movement of an internal floor of the pre-roll packing device, such that the plurality of pre-rolled tubes can be uniformly filled and packed with the smoking material.

In a related aspect, the tube receiving structure can include a plurality of receiving tubes, which can each further include:

a) a receiving interior, which can be cone-shaped, such that the receiving interior gradually narrows from an upper end of the interior to a lower end of the interior;

wherein the interior can be configured to taper in width from a wider top to a narrower bottom of the interior;

such that the receiving interior can be configured to receive a pre-rolled tube.

In a related aspect, the tube receiving structure can further include:

a) a main receiving portion; and b) an extender receiving portion, which is configured to be removably installable on a top of the main receiving portion;

such that the extender receiving portion can be configured to be removable;

such that the tube receiving structure is configurable to receive normal length pre-rolled tubes, when the extender receiving portion is not installed; and such that the tube receiving structure is configurable to receive elongated length pre-rolled tubes, when the extender receiving portion is installed.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1A:
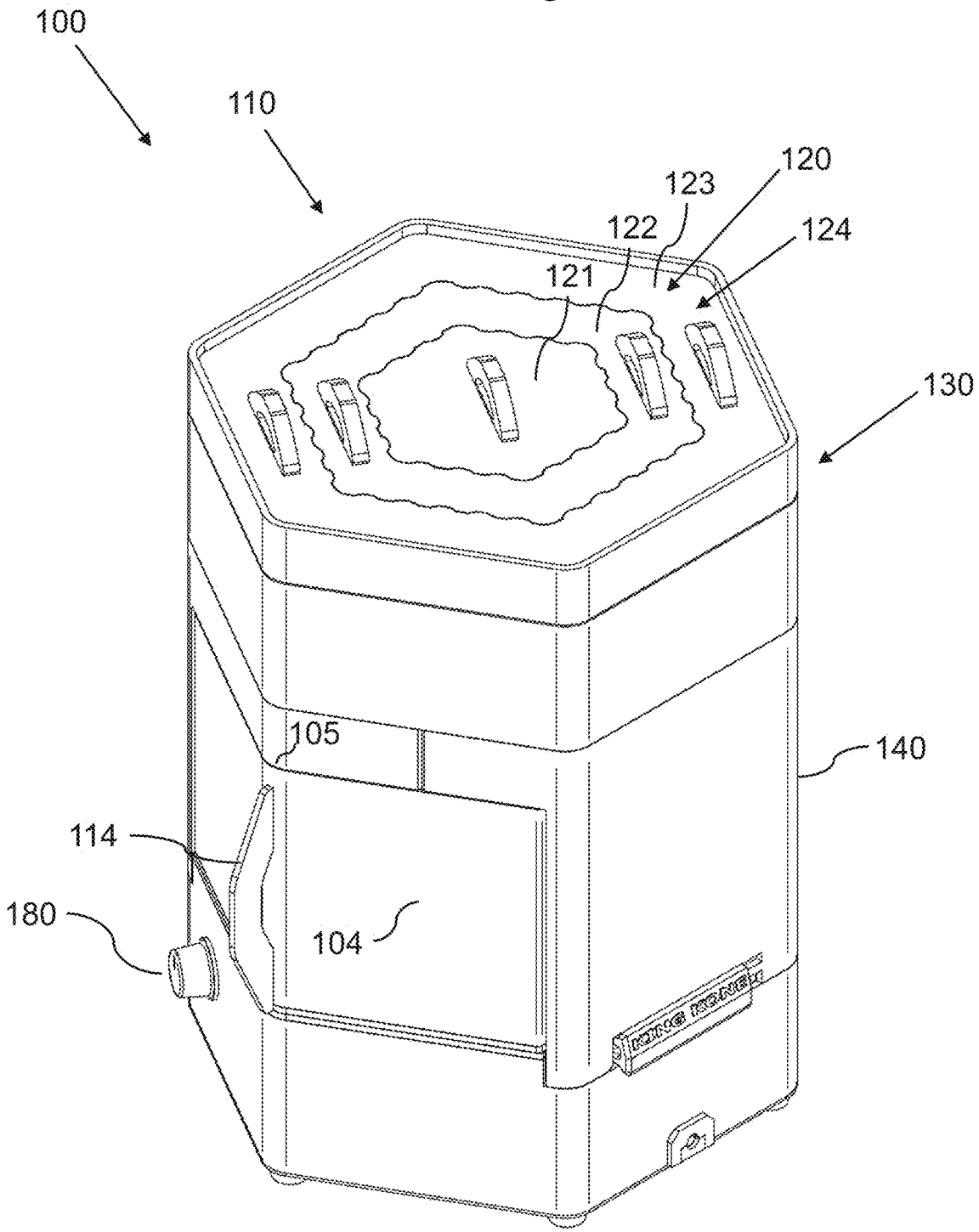
FIG. 1A is a perspective view of a pre-roll packing device of a pre-roll packing system, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a tube packing system 100 with reference to FIG. 1, in such manner that like reference numerals refer to like components throughout; a convention that we shall employ for the remainder of this specification.

Figure 1B:
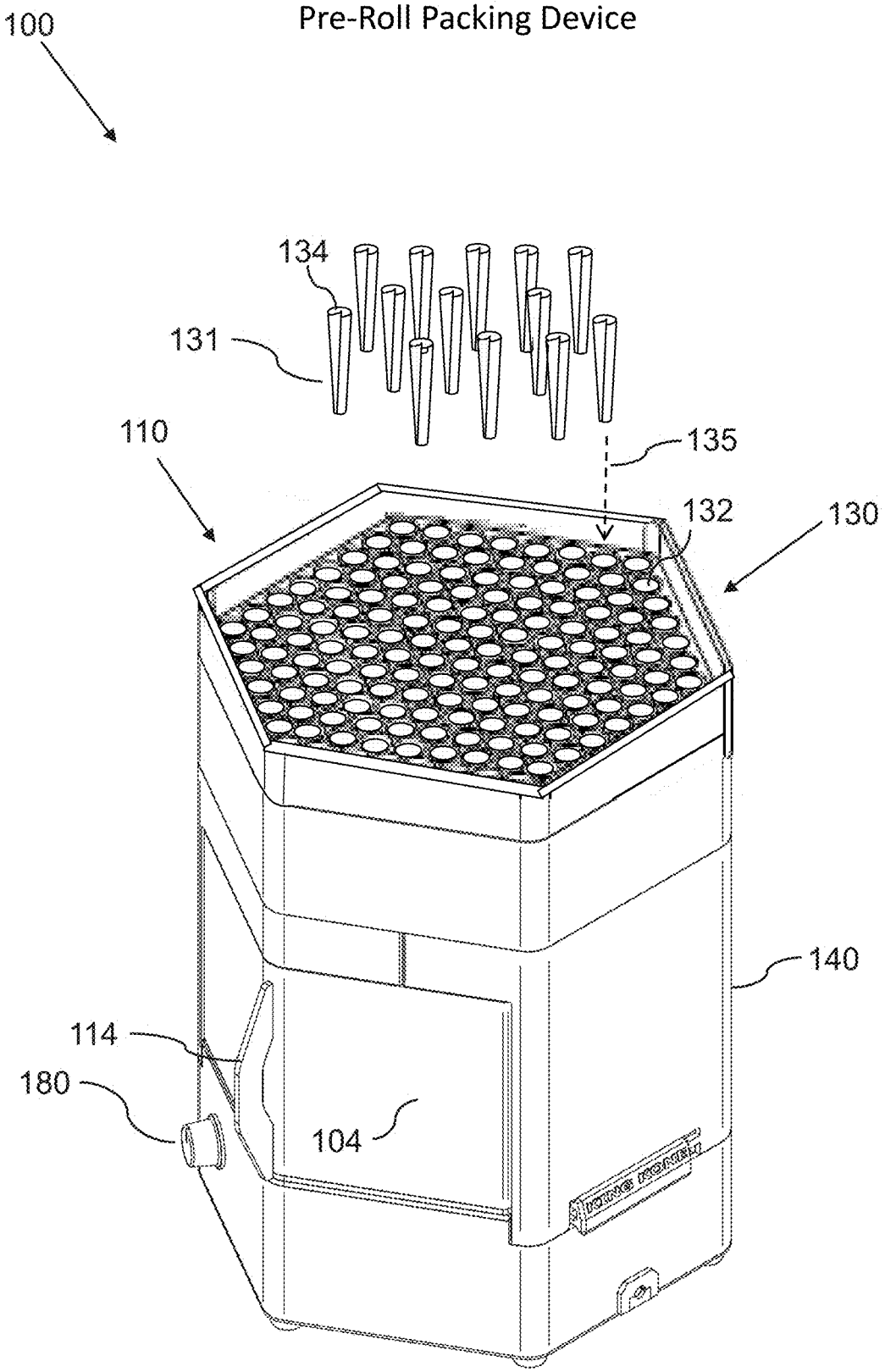
FIG. 1B is a perspective view of a pre-roll packing device of a pre-roll packing system prior to insertion of a plurality of pre-rolled tubes, according to an embodiment of the invention.
Figure 3A:
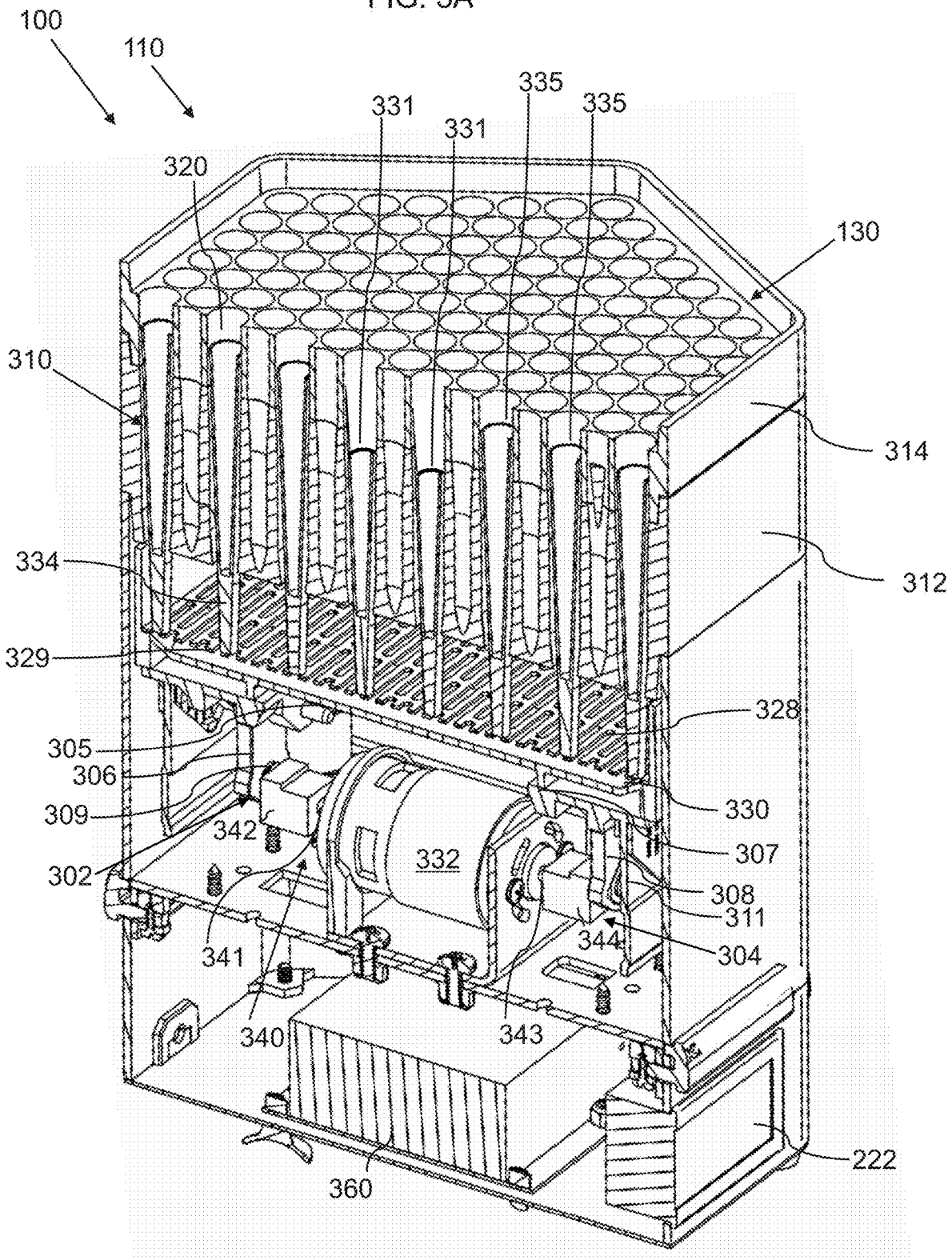
FIG. 3A is a top perspective cross-sectional view of a pre-roll packing device of a pre-roll packing system, according to an embodiment of the invention.
Figure 3B:
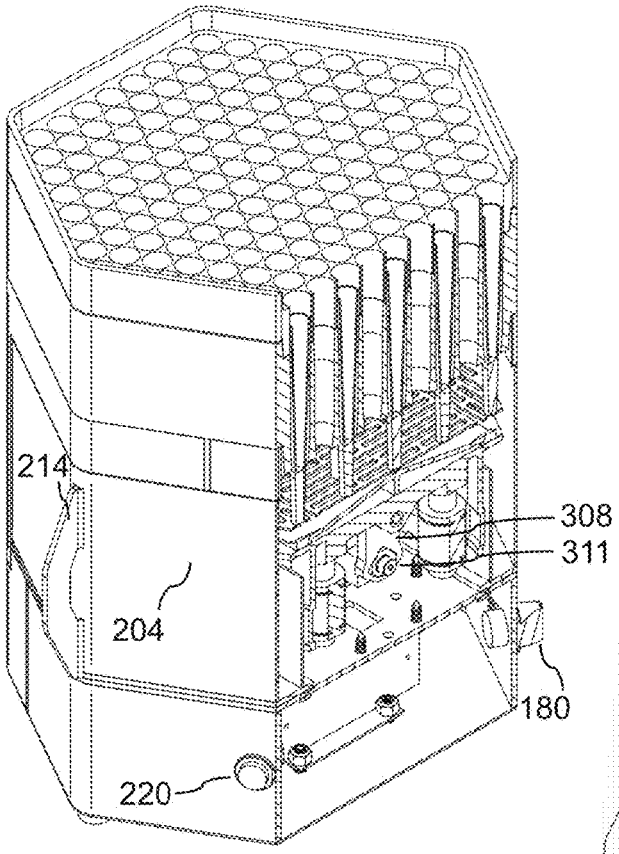
FIG. 3B is a top perspective cross-sectional view of a pre-roll packing device of a pre-roll packing system, according to an embodiment of the invention.
Figure 3C:
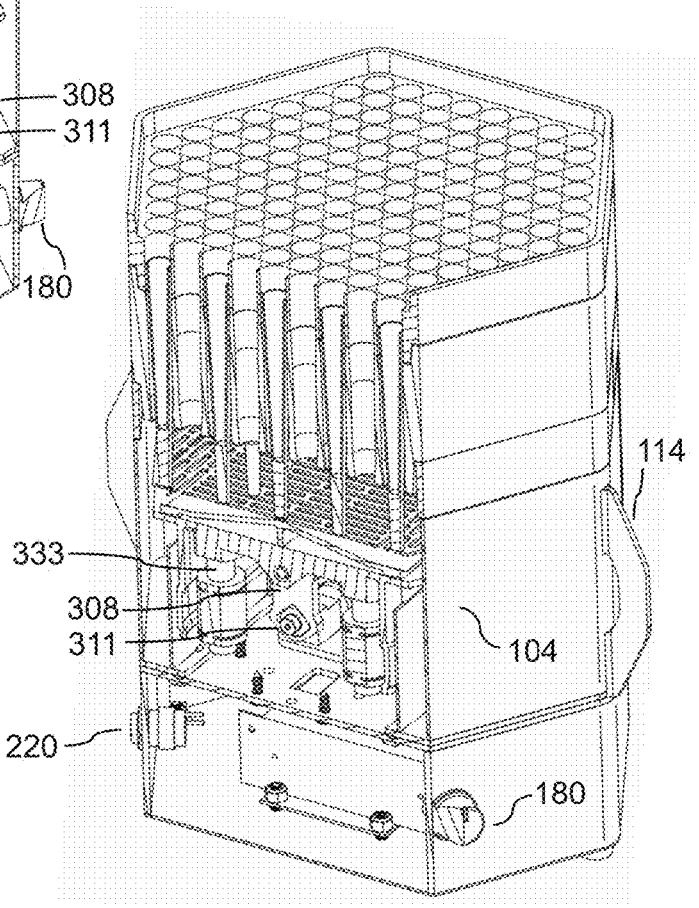
FIG. 3C is a top perspective cross-sectional view of a pre-roll packing device of a pre-roll packing system, according to an embodiment of the invention.
Figure 3D:
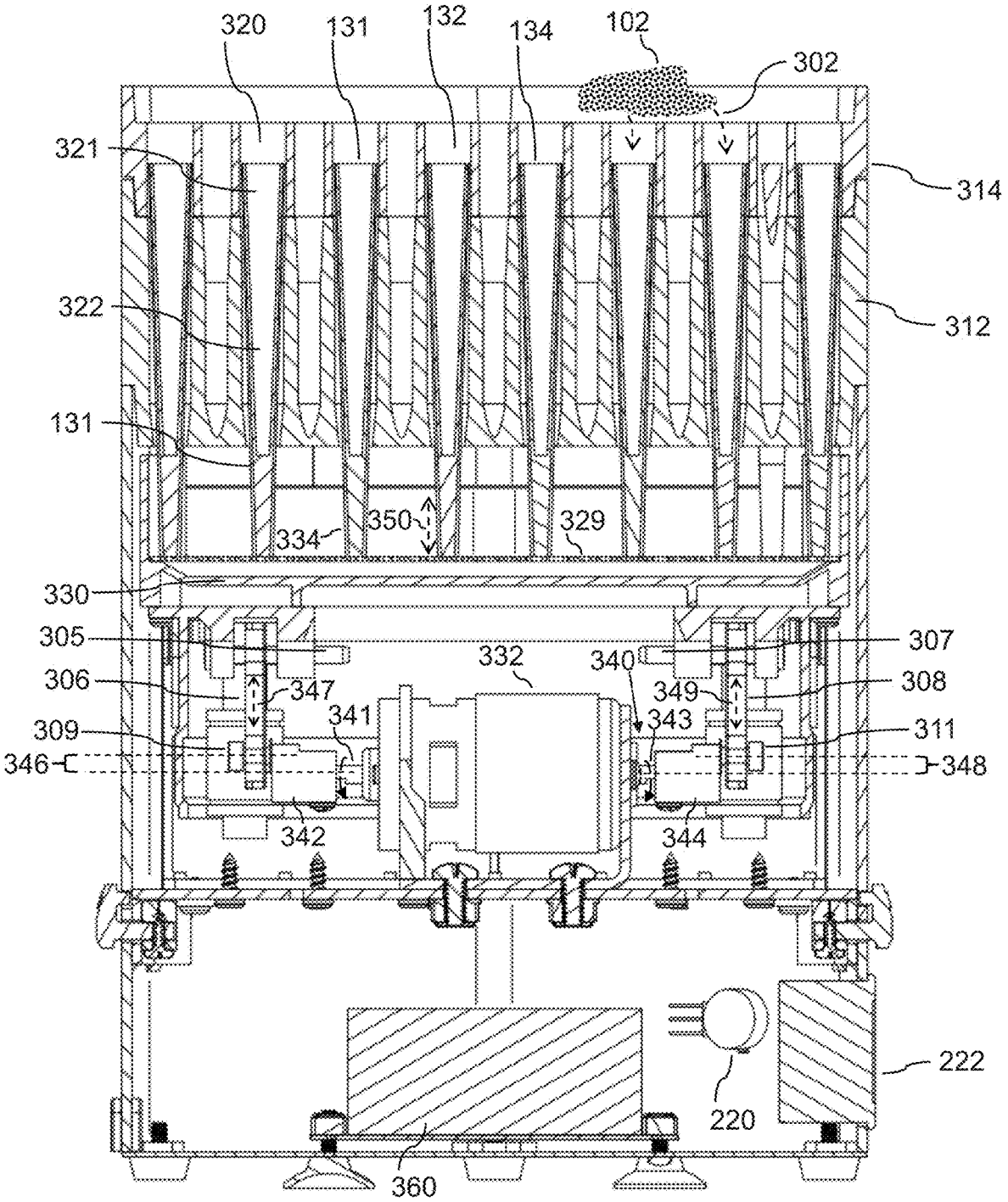
FIG. 3D is a cross-sectional view of a of a pre-roll packing device of a pre-roll packing system, according to an embodiment of the invention.
Figure 3E:
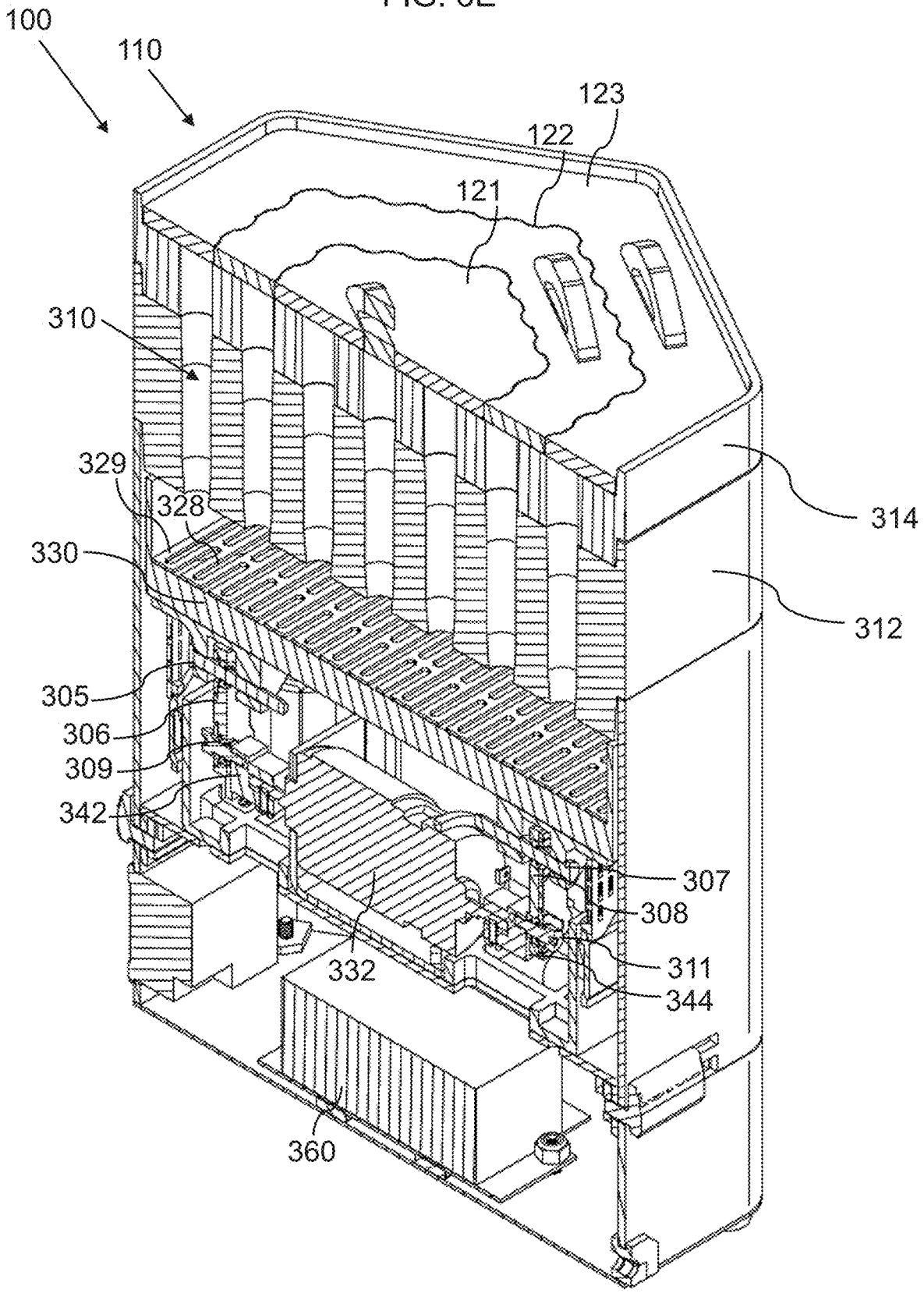
FIG. 3E is a top perspective cross-sectional view of a pre-roll packing device of a pre-roll packing system, according to an embodiment of the invention.

In an embodiment, a pre-roll packing device 110, as shown in FIGS. 1A, 1B, 1C, 3A and 3D, for packing a plurality of pre-rolled tubes 131 with a smoking material 102, which can for example be a herb material, including ground/shredded/cut tobacco or a ground/shredded/cut cannabis material, such that the pre-roll packing device 110 can include:

a) a tube receiving structure 130, as shown in FIG. 1B;

b) an internal floor 329, which is mounted below the tube receiving structure 130, as shown in FIGS. 3A and 3D; and c) a removable lid 120, as shown in FIG. 1A;

wherein the plurality of pre-rolled tubes 131, can be inserted 135 into the tube receiving structure 130, such that each pre-rolled tube 131 in the plurality of pre-rolled tubes 131 is disposed in a vertical orientation with an upper opening 134 of the pre-rolled tube 131 facing upward;

such that the smoking material 102 can be dispensed onto an upper surface of the tube receiving structure 130, such that the tube receiving structure is configured to enable the smoking material 102 to fall 302 into the upper openings of the pre-rolled tubes 131, when the smoking material 102 is dispensed onto an upper surface of the tube receiving structure 130, as shown in FIG. 3D;

such that a user can place the removable lid atop the tube receiving structure 130;

wherein lower ends 334 of the pre-rolled tubes 131 protrude below the tube receiving structure 130, such that the lower ends 334 of the pre-rolled tubes 131 make contact with the internal floor 329, i.e. such that the lower ends 334 of the pre-rolled tubes 131 rest on the internal floor 329, as shown in FIGS. 3A-3D;

such that the pre-roll packing device 110 can be configured to create a cyclical vertical movement 350 of the internal floor 329 of the pre-roll packing device 110 (i.e. a cyclical up and down movement 350 of the internal floor 329), such that the pre-rolled tubes 131 are moved vertically (i.e. moved consecutively up and down) by the cyclical vertical movement 350 of the internal floor 329, such that the smoking material 102 falls 302 into the upper openings of the pre-rolled tubes 131, such that the plurality of pre-rolled tubes 131 can be uniformly filled and packed with the smoking material 102.

In a related embodiment, as shown in FIGS. 1A, the tube receiving structure 130 can include a plurality of receiving tubes 132, which each protrude vertically through the tube receiving structure 130, such that an upper opening of each receiving tube 132 can be exposed on the upper surface of the tube receiving structure 130, such that the receiving tubes 132 can be configured as vertical apertures that protrude vertically through the tube receiving structure 130, wherein each receiving tube 132 can further include:

a) a receiving interior 320, as shown in FIG. 3A, which protrudes vertically through the tube receiving structure 130, wherein the receiving interior 320 can be cone-shaped, such that the receiving interior 320 gradually narrows from an upper end 321 of the interior 320 to a lower end 322 of the interior 320, such that a lower end 334 of the pre-rolled tube 131 protrudes below the receiving interior 320, such that the lower end 334 of the pre-rolled tube 131 makes contact with the internal floor 329, as shown in FIGS. 3A and 3D;

wherein the interior 320 can be configured to taper in width from a wider top to a narrower bottom of the interior 320;

such that the receiving interior 320 can be configured to receive a pre-rolled tube 131, which is cone-shaped. Alternatively, the receiving interior 320 can be shaped to receive a pre-determined shape of pre-rolled tubes 131 with a particular shape; which can include a straight shape, such that the receiving interior 320 can for example be a straight cylinder, configured to receive a straight cylindrical pre-rolled tube 131, such as for producing a conventional cigarette;

such that a central portion of each pre-rolled tube 131 is moved cyclically vertically (i.e. moved cyclically/consecutively up and down) inside a substantially stationary receiving tube 132.

In a related embodiment, as shown in FIGS. 3A, the tube receiving structure 130 can further include:

a) a main receiving portion 312; and b) an extender receiving portion 314, which can be configured to be removably installable on a top of the main receiving portion 312;

such that the extender receiving portion 314 can be configured to be removable;

such that the tube receiving structure 130 can be configurable to receive normal/first length pre-rolled tubes 331, when the extender receiving portion 314 is not installed; and such that the tube receiving structure 130 can be configurable to receive elongated/second length pre-rolled tubes 335 (which are longer than the normal length pre-rolled tubes 131), when the extender receiving portion 314 is installed.

Figure 1C:
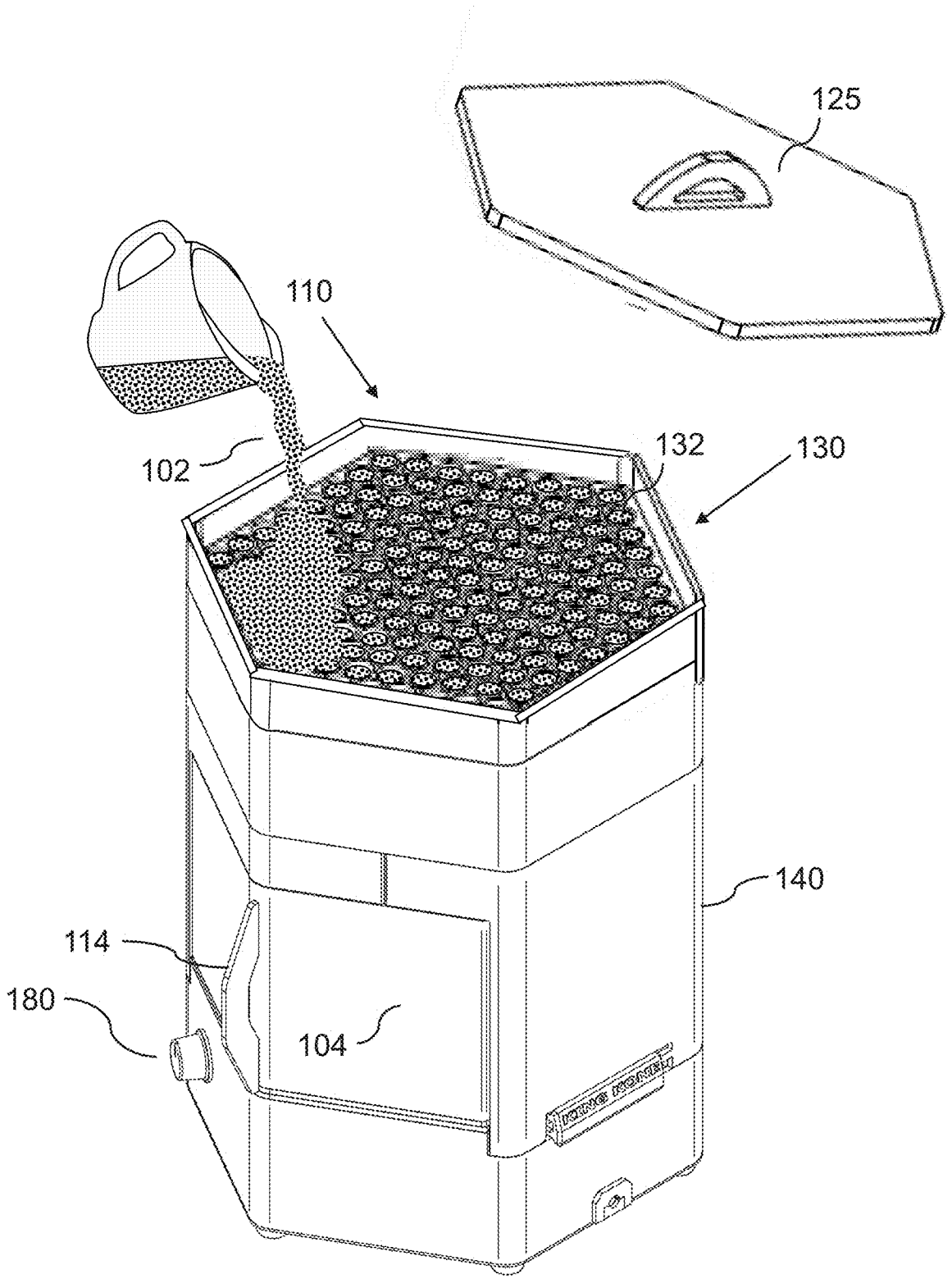
FIG. 1C is a perspective view of a pre-roll packing device of a pre-roll packing system with a plurality of pre-rolled tubes inserted and a smoking material dispensed onto an upper surface of the tube receiving structure, according to an embodiment of the invention.

In a related embodiment, as shown in FIGS. 3A, the pre-roll packing device 110 can further include:

a) an electric engine 332, as shown in FIG. 3A, which comprises a left end 341 of a rotatable shaft 340 and a right end 343 of the rotatable shaft 340 (or alternatively a left rotatable shaft 341 and a right rotatable shaft 343), such that the electric engine 332 can be configured to create the vertical movement of the internal floor 329 of the pre-roll packing device 110; and In a related embodiment, as shown in FIGS. 1A, 1B and 1C, the pre-roll packing device 110 can be configured to include a power supply 360, as shown in FIG. 3A, wherein the power supply 360 can be placed on a lower portion of the pre-roll packing device 110 such that the activation of the power supply 360 can be configured to activate the electric engine 332.

Figure 2A:
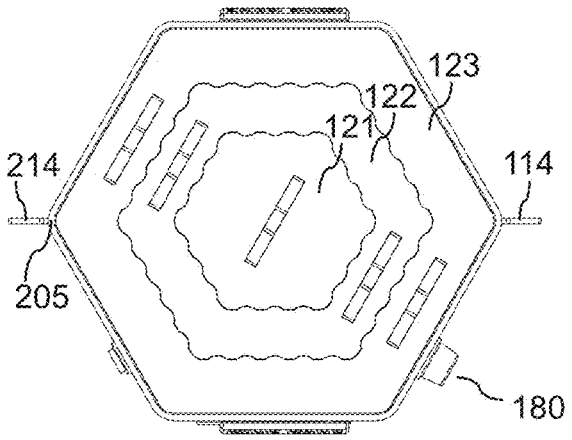
FIG. 2A is a top view of a pre-roll packing device of a pre-roll packing system, according to an embodiment of the invention.
Figure 2B:
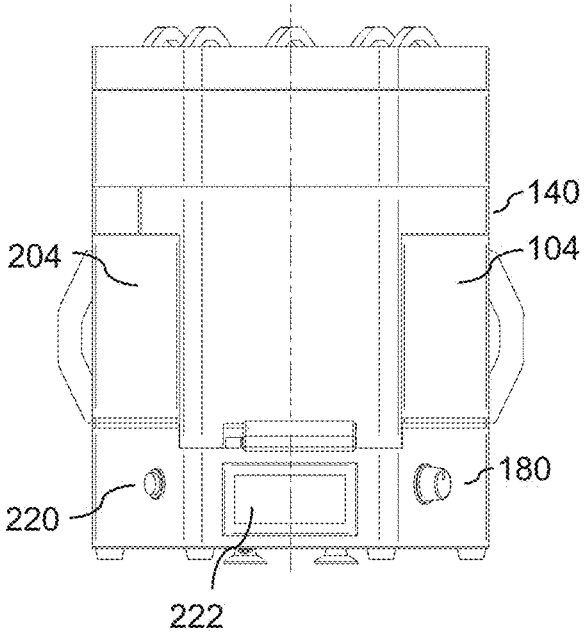
FIG. 2B is a side view of a pre-roll packing device of a pre-roll packing system, according to an embodiment of the invention.
Figure 2C:
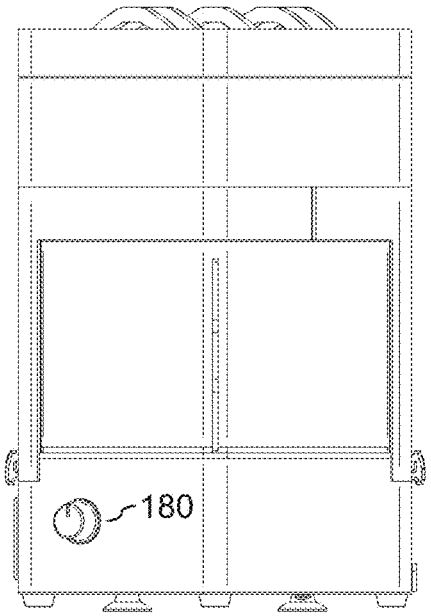
FIG. 2C is a side view of a pre-roll packing device of a pre-roll packing system, according to an embodiment of the invention.
Figure 2D:
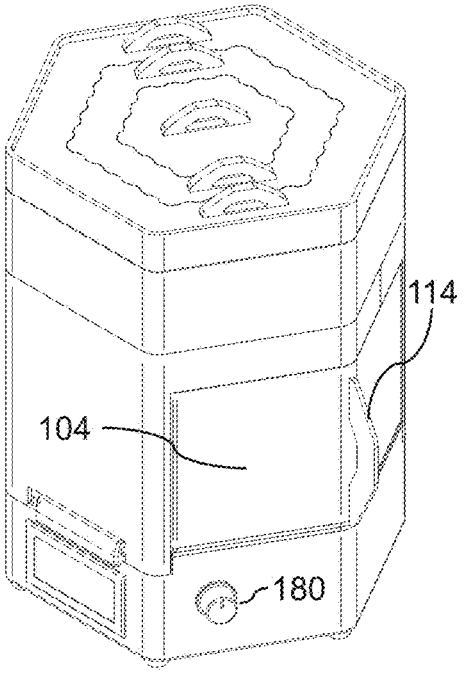
FIG. 2D is a top perspective view of a pre-roll packing device of a pre-roll packing system, according to an embodiment of the invention.

In a related embodiment, as shown in FIGS. 2B and 3B, the pre-roll packing device 110 can further include a power switch 220, which can be configured to activate (i.e. switch on or off) the electric engine 332.

In a related embodiment, as shown in FIGS. 1A, 1B and 1C, the pre-roll packing device 110 can be configured to include a potentiometer button 180, such that adjustment of the potentiometer button 180 can be configured to adjust a rotation per minute of the electric engine 332, such that the potentiometer button 180 can allow the pre-roll packing device 110 to be adjustable between a range of for example 5 rpm to 2000 rpm; or another preferred range, for example with rpm higher than 2000, such as up to 3000, or 5000 rpm, or higher.

In a related embodiment, as shown in FIG. 2B, the pre-roll packing device 110 can be configured to include an rpm display 222, such that the rpm value can be shown on the rpm display 222.

In an embodiment, as shown in FIGS. 3A, the pre-roll packing device 110 can further include:

a) a left cam connector 342, which can be connected to a left end 341 of a rotatable shaft 340 of the electric engine 332, such that the left end 341 is disposed to a left side of the electric engine 332; and b) a right cam connector 344, which can be connected to a right end 343 of the rotatable shaft 340 of the electric engine 332, such that the right end 343 is disposed to a right side of the electric engine 332;

wherein the electric engine 332 has a dual-ended rotatable shaft 340, such that the left end 341 and the right end 343 of the rotatable shaft 340 rotate (i.e. are rotatable) with a synchronized rotation;

such that rotations of the left cam connector 342 and the right cam connector 344 are synchronized.

In a related embodiment, as shown in FIGS. 3A and 3D, the pre-roll packing device 110 can further include:

a) a left cam movement arm 306, which can be rotatably connected to a left-side surface of the left cam connector 342, in an offset position 346 from the left end portion of the rotatable shaft 341 of the electric engine 332, as shown in FIG. 3D; and such that the left cam connector 342 can be configured to translate a rotational movement of the left end portion of the rotatable shaft 341 of the electric engine 332 to a cyclical linear vertical movement 347 of the left cam movement arm 306; and b) a right cam movement arm 308, which is rotatably connected to a right-side surface of the right cam connector, in an offset position 348 from the right end portion of the rotatable shaft 343 of the electric engine 332, as shown in FIG. 3D; and such that the right cam connector 344 can be configured to translate a rotational movement of the right end portion of the rotatable shaft 343 of the electric engine 332 to a cyclical linear vertical movement 349 of the right cam movement arm 308;

such that the left cam connector 342 and the right cam connector 344 are each configured to translate a rotational movement of the left cam connector 342 and the right cam connector 344 (created by the rotatable shaft 343 of the electric engine 332) to synchronized linear vertical movements 347, 349 of respectively the left cam movement arm 306 and the right cam movement arm 308;

wherein upper ends of the left and right cam movement arms 306, 308 are connected to the internal floor 329 (which can be indirectly connected via intervening structures 330, 416, including the diverter tray 330 and the slidable platform 416), such that the synchronized linear vertical movements 347, 349 of respectively the left cam movement arm 306 and the right cam movement arm 308 create the cyclical vertical movement of the internal floor 329;

whereby the activation of the electric engine 332 can be configured to create the vertical movement of the left cam movement arm 306 and the right cam movement arm 306.

In an embodiment, as shown in FIG. 3A, the pre-roll packing device 110 can include:

a) an internal floor 329, which can be configured to be mounted below the tube receiving structure 130, as shown in FIG. 3A, wherein the internal floor can be configured with a plurality of apertures 328, such that the internal floor can be configured to allow flow of excess smoking material 102 caused by the cyclical vertical movement 350 of the pre-roll packing device 110.

Figure 4A:
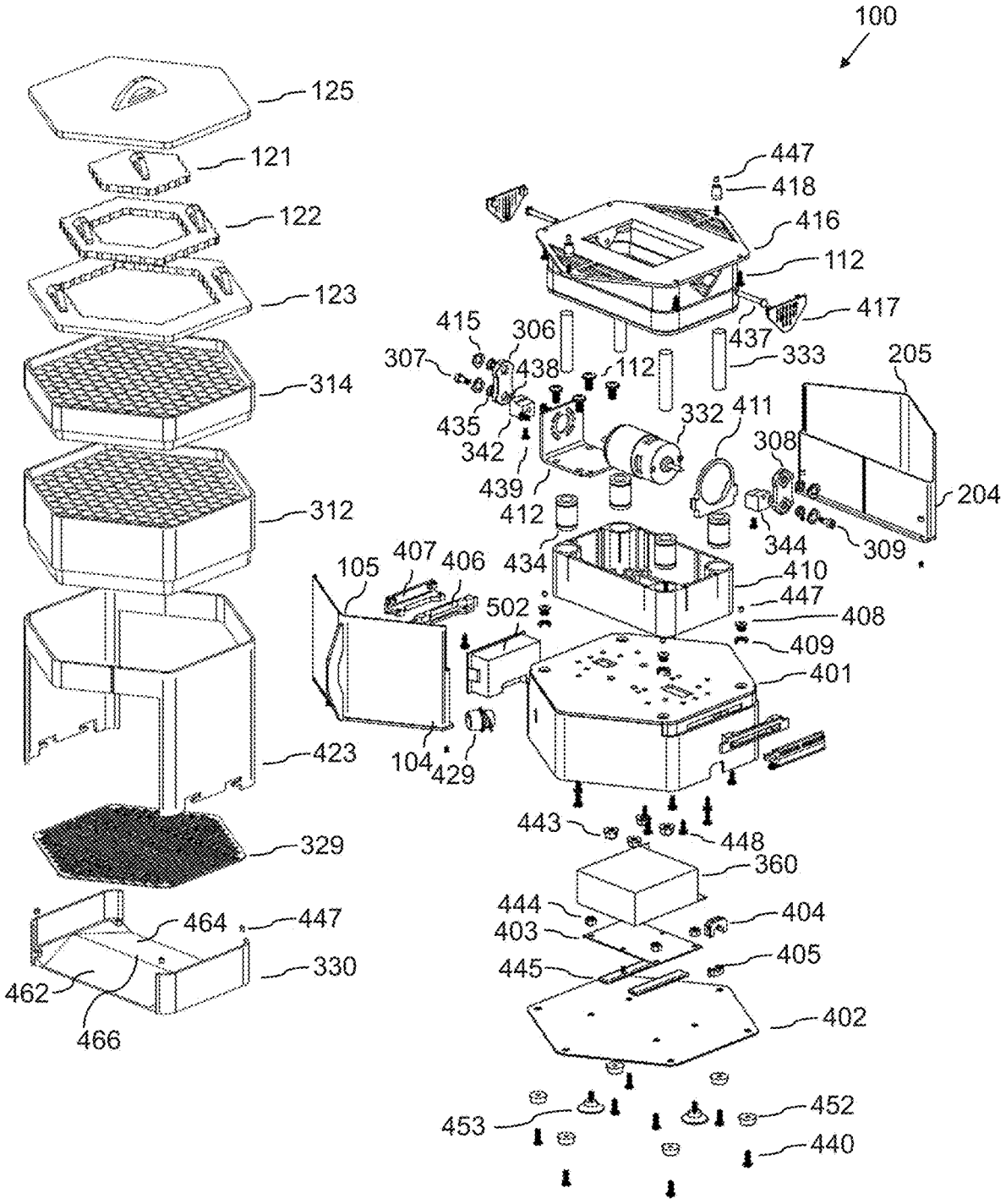
FIG. 4A is a top perspective exploded part view of a pre-roll packing device of a pre-roll packing system, according to an embodiment of the invention.
Figure 4B:
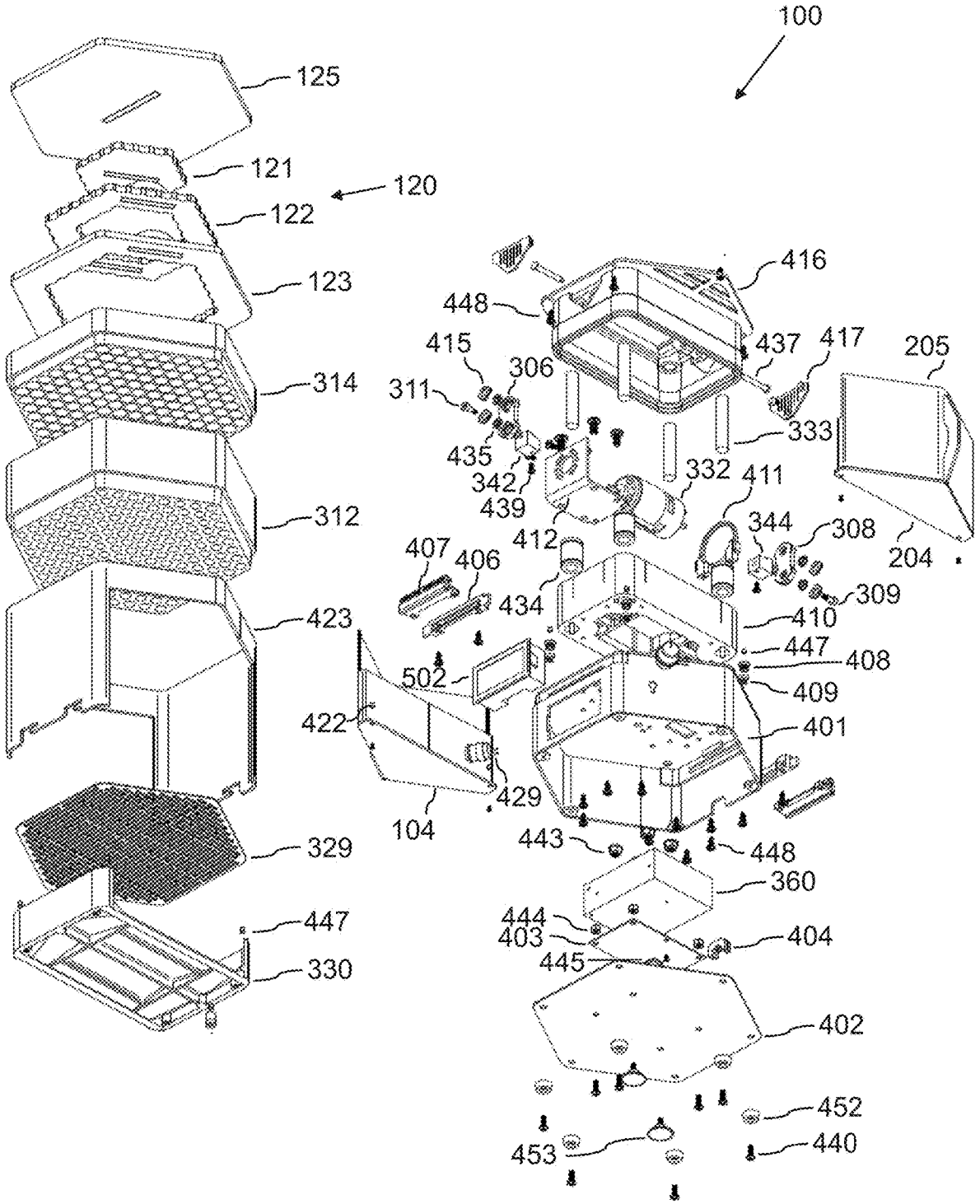
FIG. 4B is bottom perspective exploded part view of a pre-roll packing device of a pre-roll packing system, according to an embodiment of the invention.

In an embodiment, as shown in FIGS. 3A and 4A, the pre-roll packing device 110 can further include:

a diverter tray 330, which can be mounted below the internal floor 329, wherein the diverter tray 330 can further include:

a left downward slanting surface 462; and a right downward slanting surface 464; which can be connected along center portion 466 of the diverter tray 330;

such that the diverter tray 330 can be configured to facilitate a flow of the excess smoking material to a left side and a right side of the diverter tray 330.

In a related embodiment, as shown in FIGS. 3A, 3C, 4A, and 4B, the pre-roll packing device 110 can further include:

a) A slidable platform 416; and b) A plurality of platform legs 333, which are slidably mounted to a body 140 of the pre-roll packing device 110, such that upper ends of the platform legs 333 are connected to the slidable platform 416;

wherein upper ends of the left cam movement arm 306 and the right cam movement arm 308 are pivotably connected to a bottom of the slidable platform 416 (similar to a pivotal connection of a piston shaft with a piston, to enable vertical movement of the slidable platform, while an angle of the movement arms 306, 308 changes during movement), such that the slidable platform 416 slides cyclically up and down, corresponding to vertical movement of the left cam movement arm 306 and the right cam movement arm 308;

wherein the internal floor 329 and the diverter tray 330 are mounted on a top of the slidable platform 416.

In an embodiment, as shown in FIG. 2B, the pre-roll packing device 110 can include:

a) a first collection container 104, which can be connected to a first end of the diverter tray 330, such that the first collection container can be mountable to a first side surface of a body 140 of the pre-roll packing device 110; and b) a second collection container 204, which can be connected to a second end of the diverter tray 330, such that the second collection container can be mountable to a second side surface of the body 140 of the pre-roll packing device 110;

such that the second collection container 204 can be configured to be positioned opposite of the first collection container 104;

wherein the pre-roll packing device 110 can be configured such that the diverter tray 330 facilitates the smoking material 102 excess to fall to the first collection container 104 and the second collection container 204.

In a related embodiment, as shown in FIGS. 1A and 2A, wherein the first collection container 104 and the second collection container 204 can include:

a) a first collection container handle 114; and b) a second collection container handle 214;

such that the first collection container 104 and the second collection container 204 can be configured to be removable via the first collection container handle 114 and the second collection container handle 214, such that the smoking material 102 excess can be saved for re-use.

In another related embodiment, as shown in FIGS. 1A, 2A, 4A, and 4B, the first collection container 104 and the second collection container 204 can each include:

a) a pouring portion 105, 205;

wherein the pouring portion can be configured as a spout or an angled protruding portion 105, 205, as shown in 4A and 4B;

such that the pouring portions 105, 205 each facilitate pouring of the excess smoking material 102, for example to pour the excess smoking material 102 back onto a top of the tube receiving structure 130.

In another related embodiment, as shown in FIGS. 1A and 2A, the first collection container 104 and the second collection container 204 can each include:

a) a collection container handle 114, 214;

such that the first collection container 104 and the second collection container 204 are configured to be removable.

In an embodiment, as shown in FIG. 1A, the removable lid 120 can be configured as a lid assembly 124, which can include:

a) an outer compartment portion 123;

b) an intermediate compartment portion 122, such that the intermediate compartment portion 122 can be removably positionable inside the outer compartment portion 123; and c) an inner compartment portion 121 such that the inner compartment portion 121 can be removably positionable inside the intermediate compartment portion 122; and such that the pre-roll packing device 110 can be configurable for use of an entire portion of the tube receiving structure 130, by removal of the outer compartment portion 123, the intermediate compartment portion 122, and the inner compartment portion 121;

such that the pre-roll packing device 110 can be configurable for use of an intermediate portion of the tube receiving structure 130, by removal of the intermediate compartment portion 122 and the inner compartment portion 121;

such that the pre-roll packing device 110 can be configurable for use of an inner portion of the tube receiving structure 130, by removal of the inner compartment portion 121;

whereby the tube packing system 100 is adaptable for use to prepare a preferential batch amount.

In an embodiment, as shown in FIG. 1C, the tube packing system 100, the removable lid 120 can be configured as a one-piece removable lid 125, which can be configured to provide access to the entire portion of the tube receiving structure 130.

Figure 5:
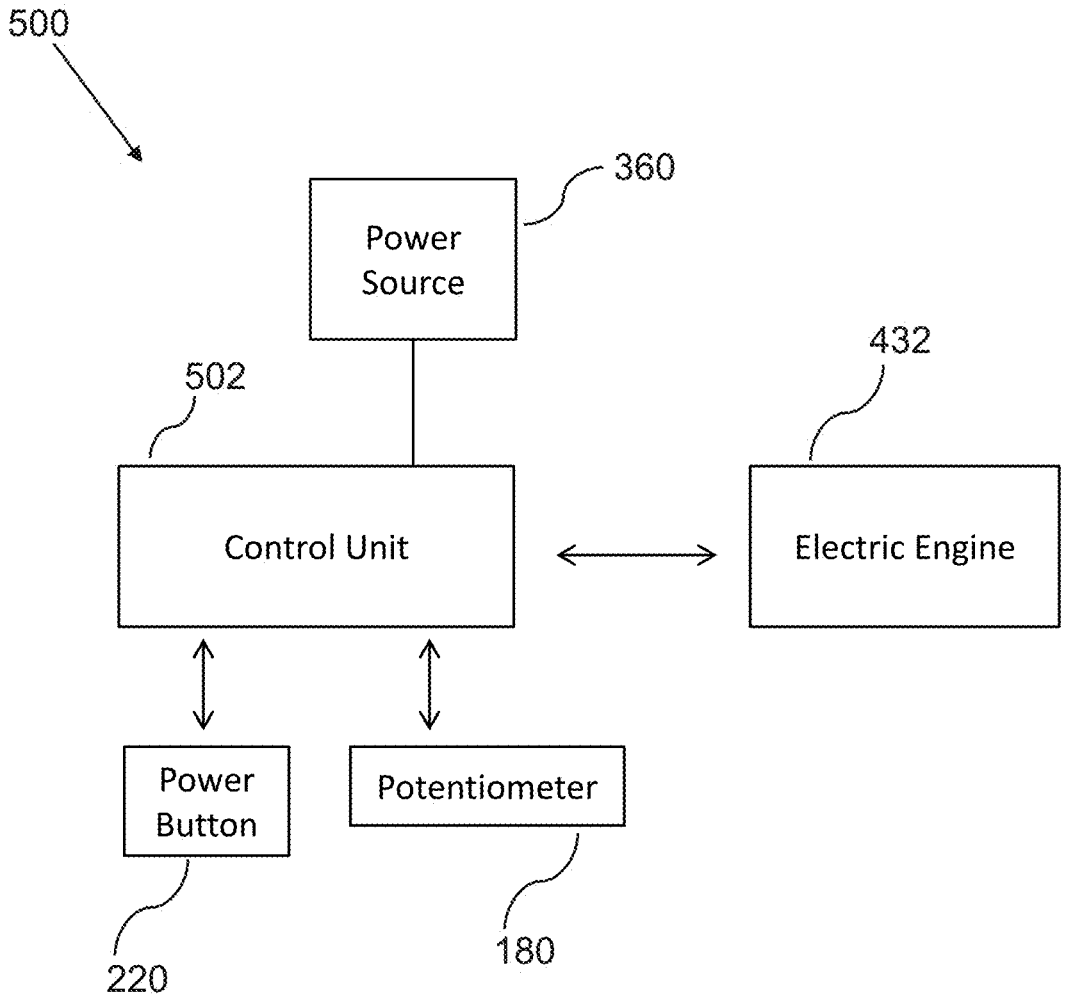
FIG. 5 is a schematic diagram illustrating a control system for the pre-roll packing device, according to an embodiment of the invention.
Figure 6:
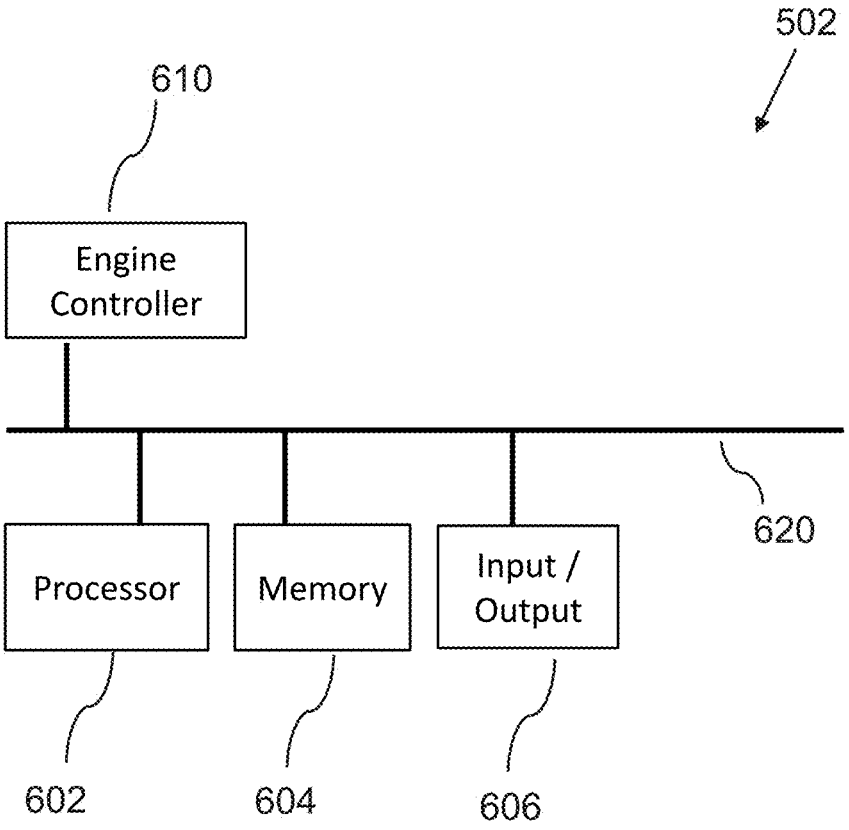
FIG. 6 is a schematic diagram illustrating a control unit of the control system for the pre-roll packing device, according to an embodiment of the invention.

In a related embodiment, as shown in FIGS. 5, the pre-roll packing device 110 can further include a control system 500, which can include:

a) an electric engine 432 (also referred to as a dc motor 432);

b) a power source 360 (also referred to as a power supply 360);

c) A power button 220;

d) A potentiometer 180; and e) A control unit 502 (also referred to as a dc controller 502), which is configured to control the electric engine 432, for example to control RPM and pulse cycle duration and frequency;

In a further related embodiment, as shown in FIG. 6, the control unit 502 can include:

a) A processor 602;

b) A non-transitory memory 604;

c) An input/output component 606; and d) An engine controller 610, which is configured to control the electric engine 432; all connected via e) A data bus 620.

In various related embodiments, parts of the tube packing system 100 can be:

a) injection molded or 3D-printed in a plastic material, such as Acrylonitrile butadiene styrene (ABS), High-density polyethylene (HDPE), Polyethylene terephthalate glycol (PETG), or other suitable thermoplastic polymers;

b) made from a sheet metal alloy, including stainless steel sheet material and high strength sheet alloys;

c) made from composite materials, including glass fiber, carbon fiber, and composites thereof; and/or d) combinations of these.

In a related embodiment, parts of the tube packing system 100 can include:

a) a base 401, which for example can be made from 304 Stainless Steel;

b) a Base Bottom Cover 402, which for example can be made from 304 Stainless Steel;
c) a Power Supply Plate 403, which for example can be made from 304 Stainless Steel;
d) a Base Cord Lock 404, which for example can be made from PETG/ABS/Resin;
e) a Base Cord Lock Lower 405, which for example can be made from PETG/ABS/Resin;
f) 2 Stand Lock Guides 406, which for example can be made from PETG/ABS/Resin;
g) 2 Stand Locks 407, which for example can be made from PETG/ABS/Resin;
h) 4 Base Trough Magnet Holders 408, which for example can be made from PETG/ABS/Resin;
i) 4 Base Trough Magnet Holder Clips 409, which for example can be made from PETG/ABS/Resin;
j) A Base Rim 410, which for example can be made from PETG/ABS/Resin
k) A Motor Mount Rear Support 411, which for example can be made from PETG/ABS/Resin;
l) A Motor Mounting Bracket 412, which for example can be made from 304 Stainless Steel;
m) 2 Cams 342, 344, which for example can be made from 304 Stainless Steel;
n) 2 Link Arms 306, 308, which for example can be made from PETG/ABS/Resin;
o) 4 Link Arm Covers 415, which for example can be made from PETG/ABS/Resin;
p) A Docking Platform 416, which for example can be made from PETG/ABS/Resin;
q) 2 Docking Platform Vents 417, which for example can be made from PETG/ABS/Resin;
r) 2 Docking Platform Magnet Posts 418, which for example can be made from PETG/ABS/Resin;
s) A Cone Platform 329, which for example can be made from PETG/ABS/Resin;
t) A Cone Platform Slope 330, which for example can be made from PETG/ABS/Resin;
u) 2 Troughs 104, 204, which for example can be made from 304 Stainless Steel;
v) 4 Trough Screw Caps 422, which for example can be made from PETG/ABS/Resin;
w) A Stand 423, which for example can be made from 304 Stainless Steel;
x) A Containment Plate 125, which for example can be made from Lexan/Polycarbonate;
y) A Regular Size Cone 312, which for example can be made from HDPE;
z) A King Size Cone 314, which for example can be made from HDPE;
aa) A Sectional Lid 120, which for example can be made from Lexan/Polycarbonate;
bb) A DC Control Board 502;
cc) A Potentiometer 429;
dd) A Switch 430;
ee) A Power Supply 360;
ff) A DC Motor 332;
gg) Four Linear Rods 333, which for example can have dimensions 12 mm×60 mm;
hh) 4 Linear Bearing 434;
ii) 4 Link Arm Flange Bearings 435;
jj) 2 Screw Cam Link 311;
kk) 2 Clevis Pin Link Cone Platform 437;
ll) 2 Link Arm Washer 438;
mm) 2 Screw Cam Shaft 439;
nn) A Screw Cover to Power Supply Plate 440;
oo) 4 Screw Motor Mount Base 441;
pp) 2 Screw Motor Motor Mount 442;
qq) 4 Locknut Motor Mount Base 443;
rr) 4 Locknut Base Plate Power Supply 444;
ss) 2 Foam Tape Power Supply 445;
tt) Velcro Filter 446;
uu) 10 Neodymium 45 Magnet 447;
vv) 18 Plastic Screw 8-32 448;
ww) 2 6-32×7/16" 449;
xx) 2-56×3/16" 450;
yy) 2 M3×0.5 mm Thread, 6 mm Long 451;
zz) 6 Rubber Foot 452;
aaa) A 2 Rubber Suction Cup 453;
bbb) A Power Cord 454; and
ccc) A Motor Wire 455.

FIGS. 4A, 4B, 5 and 6 are block diagrams and flowcharts, methods, devices, systems, apparatuses, and computer program products according to various embodiments of the present invention. It shall be understood that each block or step of the block diagram, flowchart and control flow illustrations, and combinations of blocks in the block diagram, flowchart and control flow illustrations, can be implemented by computer program instructions or other means. Although computer program instructions are discussed, an apparatus or system according to the present invention can include other means, such as hardware or some combination of hardware and software, including one or more processors or controllers, for performing the disclosed functions.

In this regard, FIGS. 4A, 4B, 5 and 6 depict the computer devices of various embodiments, each containing several of the key components of a general-purpose computer by which an embodiment of the present invention may be implemented. Those of ordinary skill in the art will appreciate that a computer can include many components. However, it is not necessary that all of these generally conventional components be shown in order to disclose an illustrative embodiment for practicing the invention. The general-purpose computer can include a processing unit and a system memory, which may include various forms of non-transitory storage media such as random access memory (RAM) and read-only memory (ROM). The computer also may include nonvolatile storage memory, such as a hard disk drive, where additional data can be stored.

It shall be understood that the above-mentioned components of the control unit 502 are to be interpreted in the most general manner.

For example, the processor 602 can include a single physical microprocessor or microcontroller, a dedicated electronic control circuit, and the like.

In a further example, the non-transitory memory 604 can include various forms of non-transitory storage media, including random access memory and other forms of dynamic storage, and hard disks, etc. Similarly, the input/output 606 can include a plurality of well-known input/output devices, such as screens, keyboards, pointing devices, motion trackers, communication ports, and so forth.

Furthermore, it shall be understood that the control unit 502 can include a number of other components that are well known in the art of general computer devices, and therefore shall not be further described herein. This can include system access to common functions and hardware, such as for example via operating system layers such as WINDOWS™, LINUX™, and similar operating system software, but can also include configurations wherein application services are executing directly on server hardware or via a hardware abstraction layer other than a complete operating system.

An embodiment of the present invention can also include one or more input or output components, such as a mouse, keyboard, monitor, and the like. A display can be provided for viewing text and graphical data, as well as a user interface to allow a user to request specific operations. Furthermore, an embodiment of the present invention may be connected to one or more remote computers via a network interface. The connection may be over a local area network (LAN) wide area network (WAN), and can include all of the necessary circuitry for such a connection.

Typically, computer program instructions may be loaded onto the computer or other general-purpose programmable machine to produce a specialized machine, such that the instructions that execute on the computer or other programmable machine create means for implementing the functions specified in the block diagrams, schematic diagrams or flowcharts. Such computer program instructions may also be stored in a computer-readable medium that when loaded into a computer or other programmable machine can direct the machine to function in a particular manner, such that the instructions stored in the computer-readable medium produce an article of manufacture including instruction means that implement the function specified in the block diagrams, schematic diagrams or flowcharts.

In addition, the computer program instructions may be loaded into a computer or other programmable machine to cause a series of operational steps to be performed by the computer or other programmable machine to produce a computer-implemented process, such that the instructions that execute on the computer or other programmable machine provide steps for implementing the functions specified in the block diagram, schematic diagram, flowchart block or step.

Accordingly, blocks or steps of the block diagram, flowchart or control flow illustrations support combinations of means for performing the specified functions, combinations of steps for performing the specified functions and program instruction means for performing the specified functions. It will also be understood that each block or step of the block diagrams, schematic diagrams or flowcharts, as well as combinations of blocks or steps, can be implemented by special purpose hardware-based computer systems, or combinations of special purpose hardware and computer instructions, that perform the specified functions or steps.

As an example, provided for purposes of illustration only, a data input software tool of a search engine application can be a representative means for receiving a query including one or more search terms. Similar software tools of applications, or implementations of embodiments of the present invention, can be means for performing the specified functions. For example, an embodiment of the present invention may include computer software for interfacing a processing element with a user-controlled input device, such as a mouse, keyboard, touch screen display, scanner, or the like. Similarly, an output of an embodiment of the present invention may include, for example, a combination of display software, video card hardware, and display hardware. A processing element may include, for example, a controller or microprocessor, such as a central processing unit (CPU), arithmetic logic unit (ALU), or control unit.

Here has thus been described a multitude of embodiments of the pre-roll packing device 110, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A pre-roll packing device for packing a plurality of pre-rolled tubes with a smoking material, wherein the pre-roll packing device comprises:

a tube receiving structure; and an internal floor, which is mounted below the tube receiving structure;

an electric engine, which comprises a left end of a rotatable shaft and a right end of the rotatable shaft;

such that the left end and the right end of the rotatable shaft are rotatable with a synchronized rotation;

such that the electric engine is configured to create a cyclical vertical movement of the internal floor;

a left cam connector, which is connected to the left end of the rotatable shaft of the electric engine; and a right cam connector, which is connected to the right end of the rotatable shaft of the electric engine;

such that rotations of the left cam connector and the right cam connector are synchronized;

wherein the plurality of pre-rolled tubes are inserted into the tube receiving structure, such that each pre-rolled tube in the plurality of pre-rolled tubes is disposed in a vertical orientation with an upper opening of the pre-rolled tube facing upward;

such that the tube receiving structure is configured to enable the smoking material to fall from the upper surface of the tube receiving structure into the upper opening of each pre-rolled tube, when the smoking material is dispensed onto an upper surface of the tube receiving structure;

wherein lower ends of the pre-rolled tubes protrude below the tube receiving structure, such that the lower ends of the pre-rolled tubes make contact with the internal floor;

such that the pre-roll packing device is configured to create a cyclical vertical movement of the internal floor, such that the pre-rolled tubes are moved vertically by the cyclical vertical movement of the internal floor, such that the smoking material falls into each upper opening of the pre-rolled tubes, such that the pre-rolled tubes are uniformly filled and packed with the smoking material.

2. The pre-roll packing device of claim 1, further comprising:

a removable lid, which is configured to be removably positioned on a top of the tube receiving structure.

3. The pre-roll packing device of claim 2, wherein the removable lid is configured as a lid assembly, which comprises:

a) an outer compartment portion;

b) an intermediate compartment portion, such that the intermediate compartment is removably positionable inside the outer compartment portion; and c) an inner compartment portion, such that the inner compartment portion is removably positionable inside the intermediate compartment portion;

such that the pre-roll packing device is configurable for use of an entire portion of the tube receiving structure, by removal of the outer compartment portion, the intermediate compartment portion, and the inner compartment portion;

such that the pre-roll packing device is configurable for use of an intermediate portion of the tube receiving structure, by removal of the intermediate compartment portion and the inner compartment portion;

such that the pre-roll packing device is configurable for use of an inner portion of the tube receiving structure, by removal of the inner compartment portion.

4. The pre-roll packing device of claim 1, wherein the tube receiving structure further comprises a plurality of receiving tubes, which each protrude vertically through the tube receiving structure, wherein the receiving tubes each comprise:

a receiving interior, which is configured to receive a pre-rolled tube, such that a lower end of the pre-rolled tube protrudes below the receiving interior, such that the lower end of the pre-rolled tube makes contact with the internal floor.

5. The pre-roll packing device of claim 3, wherein the receiving interior is cone-shaped, such that the receiving interior narrows from an upper end of the receiving interior to a lower end of the receiving interior.

6. The pre-roll packing device of claim 1, wherein the tube receiving structure further comprises:

a) a main receiving portion; and b) an extender receiving portion, which is configured to be removably installable on a top of the main receiving portion;

wherein the extender receiving portion is configured to be removable, such that the tube receiving structure is configurable to receive normal length pre-rolled tubes, without the extender receiving portion installed; and such that the tube receiving structure is configurable to receive elongated length pre-rolled tubes, which are longer than the normal length pre-rolled tubes, when the extender receiving portion is installed.

7. The pre-roll packing device of claim 1, wherein the pre-roll packing device further comprises a power switch, which is configured to activate the electric engine.

8. The pre-roll packing device of claim 1, wherein the pre-roll packing device further comprises a potentiometer, such that adjustment of the potentiometer is configured to adjust a rotation per minute of the electric engine.

9. The pre-roll packing device of claim 1, wherein the pre-roll packing device further comprises:

a) a left cam movement arm, which is rotatably connected to the left cam connector, in an offset position from the left end of the rotatable shaft of the electric engine; and b) a right cam movement arm, which is rotatably connected to the right cam connector, in an offset position from the right end of the rotatable shaft of the electric engine;

such that the left cam connector and the right cam connector are each configured to translate a rotational movement of the left cam connector and the right cam connector to synchronized linear vertical movements of respectively the left cam movement arm and the right cam movement arm;

wherein upper ends of the left and right cam movement arms are connected to the internal floor, such that the synchronized linear vertical movements of respectively the left cam movement arm and the right cam movement arm create the cyclical vertical movement of the internal floor.

10. The pre-roll packing device of claim 9, wherein the internal floor is configured with a plurality of apertures, such that the internal floor is configured to allow flow of excess smoking material.

11. The pre-roll packing device of claim 10, further comprising:

a diverter tray, which is mounted below the internal floor, wherein the diverter tray comprises:

a left downward slanting surface; and a right downward slanting surface; which are connected along center portion of the diverter tray;

such that the diverter tray is configured to facilitate a flow of the excess smoking material to a left side and a right side of the diverter tray.

12. The pre-roll packing device of claim 11, further comprising:

a) a first collection container, which is mounted under a first end of the diverter tray, such that the first collection container is mountable to a first side surface of a body of the pre-roll packing device; and b) a second collection container, which is mounted under a second end of the diverter tray, such that the second collection container is mountable to a second side surface of the body of the pre-roll packing device;

such that the second collection container is configured to be positioned opposite of the first collection container;

wherein the pre-roll packing device is configured such that the diverter tray facilitates the excess smoking material to fall to the first collection container and the second collection container.

13. The pre-roll packing device of claim 12, wherein the first collection container and the second collection container each further comprise:

a collection container handle;

such that the first collection container and the second collection container are configured to be removable.

14. The pre-roll packing device of claim 9, further comprising:

a slidable platform;

such that the slidable platform is slidably mounted to a body of the pre-roll packing device;

wherein the internal floor is mounted on a top of the slidable platform;

wherein upper ends of the left cam movement arm and the right cam movement arm are pivotably connected to a bottom of the slidable platform, such that the slidable platform slides cyclically up and down, corresponding to the synchronized linear vertical movements of respectively the left cam movement arm and the right cam movement arm.

15. The pre-roll packing device of claim 14, further comprising:

a plurality of platform legs, which are slidably mounted to a body of the pre-roll packing device, such that upper ends of the platform legs are connected to the slidable platform.

16. A pre-roll packing device for packing a plurality of pre-rolled tubes with a smoking material, wherein the pre-roll packing device comprises:

a tube receiving structure;

an electric engine, which comprises a left end of a rotatable shaft and a right end of the rotatable shaft;

such that the left end and the right end of the rotatable shaft are rotatable with a synchronized rotation;

a left cam connector, which is connected to the left end of the rotatable shaft of the electric engine; and a right cam connector, which is connected to the right end of the rotatable shaft of the electric engine;

such that rotations of the left cam connector and the right cam connector are synchronized;

such that the electric engine is configured to create a cyclical vertical movement of the pre-rolled tubes;

wherein the plurality of pre-rolled tubes are inserted into the tube receiving structure, such that each pre-rolled tube in the plurality of pre-rolled tubes is disposed in a vertical orientation with an upper opening of the pre-rolled tube facing upward;

such that the tube receiving structure is configured to enable the smoking material to fall from the upper surface of the tube receiving structure into the upper opening of each pre-rolled tube, when the smoking material is dispensed onto an upper surface of the tube receiving structure;

such that the pre-roll packing device is configured to create a cyclical vertical movement of the pre-rolled tubes, such that the smoking material falls into each upper opening of the pre-rolled tubes, such that the plurality of pre-rolled tubes are uniformly filled and packed with the smoking material.

17. The pre-roll packing device of claim 16, further comprising:

an internal floor, which is mounted below the tube receiving structure;

wherein lower ends of the pre-rolled tubes protrude below the tube receiving structure, such that the lower ends of the pre-rolled tubes make contact with the internal floor;

such that the pre-roll packing device is configured to create a cyclical vertical movement of the internal floor, such that the pre-rolled tubes are moved vertically by the cyclical vertical movement of the internal floor.

18. The pre-roll packing device of claim 17, wherein the tube receiving structure further comprises a plurality of receiving tubes, which each protrude vertically through the tube receiving structure, wherein the receiving tubes each comprise:

a receiving interior, which is configured to receive a pre-rolled tube, such that a lower end of the pre-rolled tube protrudes below the receiving interior, such that the lower end of the pre-rolled tube makes contact with the internal floor.

* * * * *